US012146401B2

(12) United States Patent
Li et al.

(10) Patent No.: US 12,146,401 B2
(45) Date of Patent: Nov. 19, 2024

(54) METHOD FOR ESTIMATING RATE OF PENETRATION WHILE DRILLING

(71) Applicant: Schlumberger Technology Corporation, Sugar Land, TX (US)

(72) Inventors: Ling Li, Cheltenham (GB); Martin Jones, Gloucester (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 351 days.

(21) Appl. No.: 17/788,196

(22) PCT Filed: Dec. 18, 2020

(86) PCT No.: PCT/US2020/065814

§ 371 (c)(1),
(2) Date: Jun. 22, 2022

(87) PCT Pub. No.: WO2021/133648

PCT Pub. Date: Jul. 1, 2021

(65) Prior Publication Data

US 2023/0031743 A1 Feb. 2, 2023

Related U.S. Application Data

(60) Provisional application No. 62/952,506, filed on Dec. 23, 2019.

(51) Int. Cl.

| | |
|---|---|
| ***E21B 45/00*** | (2006.01) |
| ***E21B 7/06*** | (2006.01) |
| ***E21B 47/022*** | (2012.01) |

(52) U.S. Cl.
CPC ..... *E21B 45/00* (2013.01); *E21B 7/06* (2013.01); *E21B 47/022* (2013.01)

(58) Field of Classification Search
CPC ..... E21B 45/00; E21B 7/06; E21B 7/022
See application file for complete search history.

(56) References Cited

U.S. PATENT DOCUMENTS

| | | | |
|---|---|---|---|
| 5,321,982 | A | 6/1994 | Fay et al. |
| 7,058,512 | B2 | 6/2006 | Downton |

(Continued)

FOREIGN PATENT DOCUMENTS

| | | | |
|---|---|---|---|
| CN | 105102762 | A | 11/2015 |
| CN | 110275438 | A | 9/2019 |

(Continued)

OTHER PUBLICATIONS

International Search Report and Written Opinion in International Patent Application No. PCT/2020/065814, dated Apr. 16, 2021, 12 pages.

(Continued)

*Primary Examiner* — Peter J Macchiarolo
*Assistant Examiner* — John M Royston
(74) *Attorney, Agent, or Firm* — Jeffrey D. Frantz

(57) ABSTRACT

A method for estimating a rate of penetration while drilling a subterranean wellbore includes estimating a first rate of penetration while drilling using a first measurement method, estimating a second rate of penetration while drilling using a second measurement method, and combining the first and second rates of penetration to obtain a combined rate of penetration of drilling.

14 Claims, 6 Drawing Sheets

(56) References Cited

U.S. PATENT DOCUMENTS

| | | | | |
|---|---|---|---|---|
| 7,946,357 | B2 | 5/2011 | Trinh et al. | |
| 9,027,670 | B2 | 5/2015 | Sugiura | |
| 9,238,958 | B2 | 1/2016 | Teodorescu | |
| 9,273,547 | B2 | 3/2016 | Brooks et al. | |
| 9,404,355 | B2 | 8/2016 | Bayliss | |
| 9,945,222 | B2 | 4/2018 | Sugiura et al. | |
| 9,970,285 | B2 | 5/2018 | Sugiura | |
| 10,001,004 | B2 | 6/2018 | Bayliss et al. | |
| 10,036,828 | B2 | 7/2018 | Jain | |
| 10,214,964 | B2 | 2/2019 | Hornblower et al. | |
| 2002/0195276 | A1 | 12/2002 | Dubinsky et al. | |
| 2005/0150689 | A1 | 7/2005 | Jogi et al. | |
| 2009/0090556 | A1 | 4/2009 | Chen | |
| 2013/0054146 | A1 | 2/2013 | Rasmus | |
| 2015/0090498 | A1* | 4/2015 | Hareland | E21B 45/00 175/48 |
| 2015/0324500 | A1 | 11/2015 | Meehan | |
| 2015/0377004 | A1 | 12/2015 | Hornblower | |
| 2016/0327680 | A1 | 11/2016 | Jain | |

FOREIGN PATENT DOCUMENTS

| | | | |
|---|---|---|---|
| WO | 2014160567 | A1 | 10/2014 |
| WO | 2015123318 | A1 | 8/2015 |
| WO | 2021126639 | A1 | 6/2021 |

OTHER PUBLICATIONS

First Office Action issued in Chinese Patent Application No. 202080092207.X dated Mar. 22, 2024, 26 pages.

Bayliss et al., MPC-Based Feedback Delay Compensation Scheme for Directional Drilling Attitude Control, SPE/IADC-173009-MS, presented at the SPE/IADC Drilling Conference and Exhibition held in London, GB March 17-19, 2015, 13 pages.

* cited by examiner

METHOD FOR ESTIMATING RATE OF PENETRATION WHILE DRILLING

CROSS REFERENCE TO RELATED APPLICATIONS

This application is the National Stage Entry of International Application No. PCT/US2020/065814, filed Dec. 18, 2020, which claims the benefit of, and priority to, U.S. Patent Application No. 62/952,506, filed Dec. 23, 2019, which application is expressly incorporated herein by this reference in its entirety.

BACKGROUND

The use of automated drilling methods is becoming increasingly common in drilling subterranean wellbores. Such methods may be employed, for example, to control the direction of drilling based on various downhole feedback measurements, such as wellbore inclination and azimuth measurements made while drilling or logging while drilling measurements. For example, such methods may be intended to control the wellbore curvature such as the build rate or turn rate of the wellbore, or to control a complex curve while drilling.

One difficulty with implementing such automated drilling methods is accurately correlating time domain surveying measurements (e.g., wellbore inclination and azimuth) with an appropriate measured depth in the wellbore. The rate of penetration (ROP) of drilling is generally required to convert time domain measurements to the measured depth domain. While ROP is commonly measured at the surface, a suitable communications channel is not always available to downlink the ROP measurements.

SUMMARY

A method for estimating a rate of penetration while drilling is disclosed. The method includes rotating a bottom hole assembly in a subterranean wellbore to drill, the drill string including a rotary steerable tool or a steerable drill bit. A first rate of penetration of drilling is measured using a first measurement method and a second rate of penetration of drilling is measured using a second measurement method. The first and second rates of penetration are combined to obtain a combined rate of penetration of drilling.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Methods for estimating a rate of penetration while drilling a subterranean wellbore are disclosed. In some embodiments, the methods include estimating a first rate of penetration while drilling using a first measurement method, estimating a second rate of penetration while drilling using a second measurement method, and combining the first and second rates of penetration to obtain a combined rate of penetration of drilling.

Embodiments of the present may provide various technical advantages and improvements over the prior art. For example, in some embodiments, the disclosed embodiments provide improved methods for making downhole estimates of the rate of penetration while drilling. The disclosed embodiments may provide improved accuracy and/or enable rate of penetration measurements to be made over an entire drilling operation including vertical, curved, and horizontal sections of the wellbore. Improving rate of penetration estimates may further provide for improved automated drilling methods with improved position control.

Figure 1:
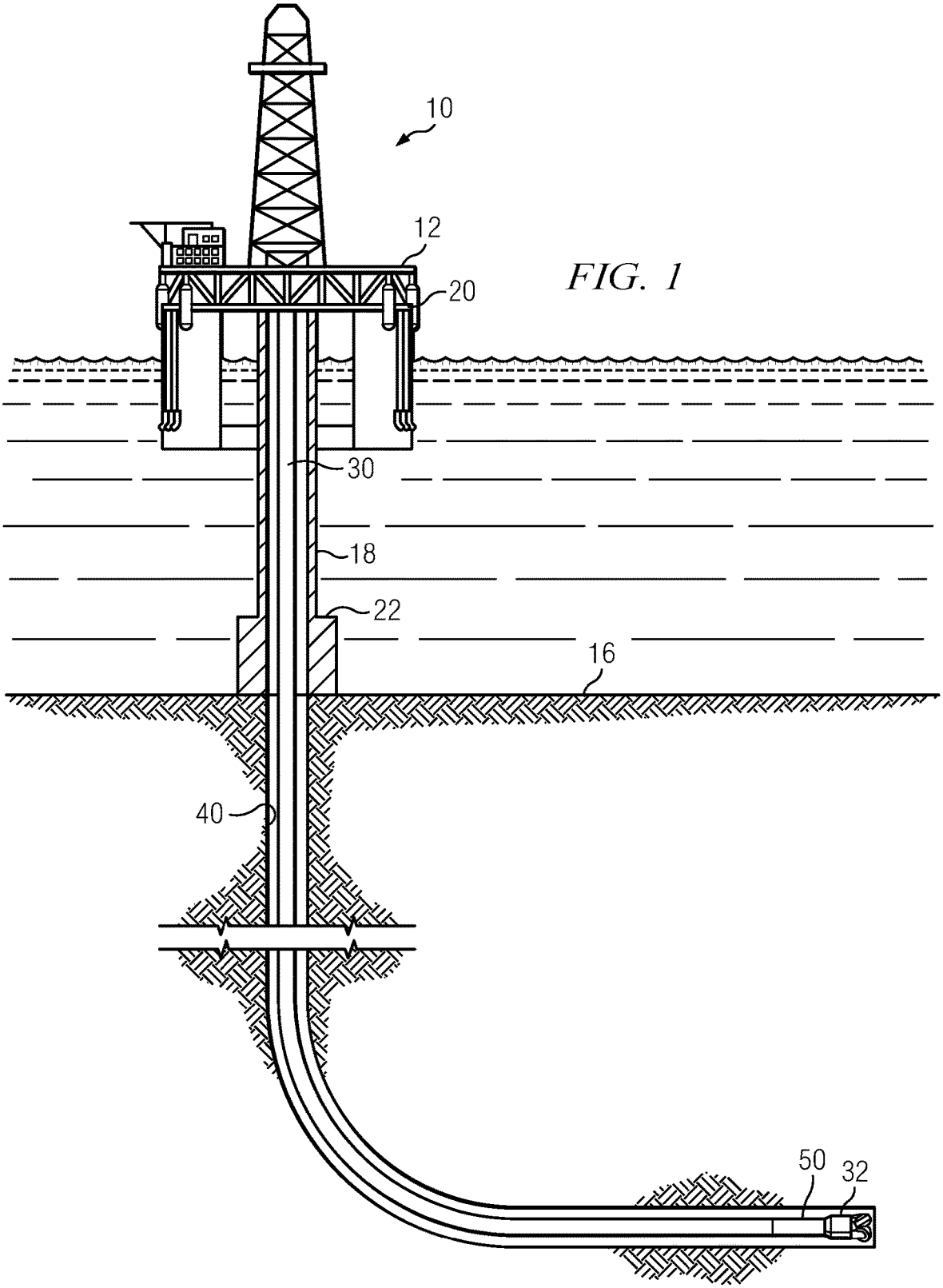
FIG. 1 depicts an example drilling rig on which disclosed embodiments may be utilized.

FIG. 1 depicts a drilling rig 10 suitable for implementing various method embodiments disclosed herein. A semisubmersible drilling platform 12 is positioned over an oil or gas formation disposed below the sea floor 16. A subsea conduit 18 extends from deck 20 of platform 12 to a wellhead installation 22. The platform may include a derrick and a hoisting apparatus for raising and lowering a drill string 30, which, as shown, extends into wellbore 40 and includes a drill bit 32 and a steering tool 50 (e.g., a rotary steerable tool). Drill string 30 may further include a downhole drilling motor, a downhole telemetry system, and one or more MWD or LWD tools including various sensors for sensing downhole characteristics of the wellbore and the surrounding formation. The disclosed embodiments are not limited in these regards.

It will be understood by those of ordinary skill in the art that the deployment illustrated on FIG. 1 is merely an example. It will be further understood that disclosed embodiments are not limited to use with a semisubmersible platform 12 as illustrated on FIG. 1. The disclosed embodiments are equally well suited for use with any kind of subterranean drilling operation, either offshore or onshore.

With continued reference to FIG. 1, steering tool 50 may include substantially any suitable steering tool, for example, including a rotary steerable tool. Rotary steerable tools include steering elements that may be actuated to control and/or change the direction of drilling the wellbore 40. In embodiments employing a rotary steerable tool, substantially any suitable rotary steerable tool configuration may be used. Numerous rotary steerable tool configurations are known in the art. For example, the AutoTrak rotary steerable system (available from Baker Hughes) and the GeoPilot rotary steerable system (available from Sperry Drilling Services) include a substantially non-rotating (or slowly rotating) outer housing employing blades that engage the wellbore wall. Engagement of the blades with the wellbore wall is intended to eccenter the tool body, thereby pointing or pushing the drill bit in a desired direction while drilling. A rotating shaft deployed in the outer housing transfers rotary power and axial weight-on-bit to the drill bit during drilling. Accelerometer and magnetometer sets may be deployed in the outer housing and therefore are non-rotating or rotate slowly with respect to the wellbore wall.

The PowerDrive rotary steerable systems (available from Schlumberger) fully rotate with the drill string (i.e., the outer housing rotates with the drill string). The PowerDrive Xceed makes use of an internal steering mechanism that does not require contact with the wellbore wall and enables the tool body to fully rotate with the drill string. The PowerDrive X5, X6, and Orbit rotary steerable systems make use of mud actuated blades (or pads) that contact the wellbore wall. The extension of the blades (or pads) is rapidly and continually adjusted as the system rotates in the wellbore. The PowerDrive Archer rotary steerable system makes use of a lower steering section joined at a swivel with an upper section. The swivel is actively tilted via pistons so as to change the angle of the lower section with respect to the upper section and maintain a desired drilling direction as the bottom hole assembly rotates in the wellbore. Accelerometer and magnetometer sets may rotate with the drill string or may alternatively be deployed in an internal roll-stabilized housing such that they remain substantially stationary (in a bias phase) or rotate slowly with respect to the wellbore (in a neutral phase). To drill a desired curvature, the bias phase and neutral phase are alternated during drilling at a predetermined ratio (referred to as the steering ratio).

Figure 2:
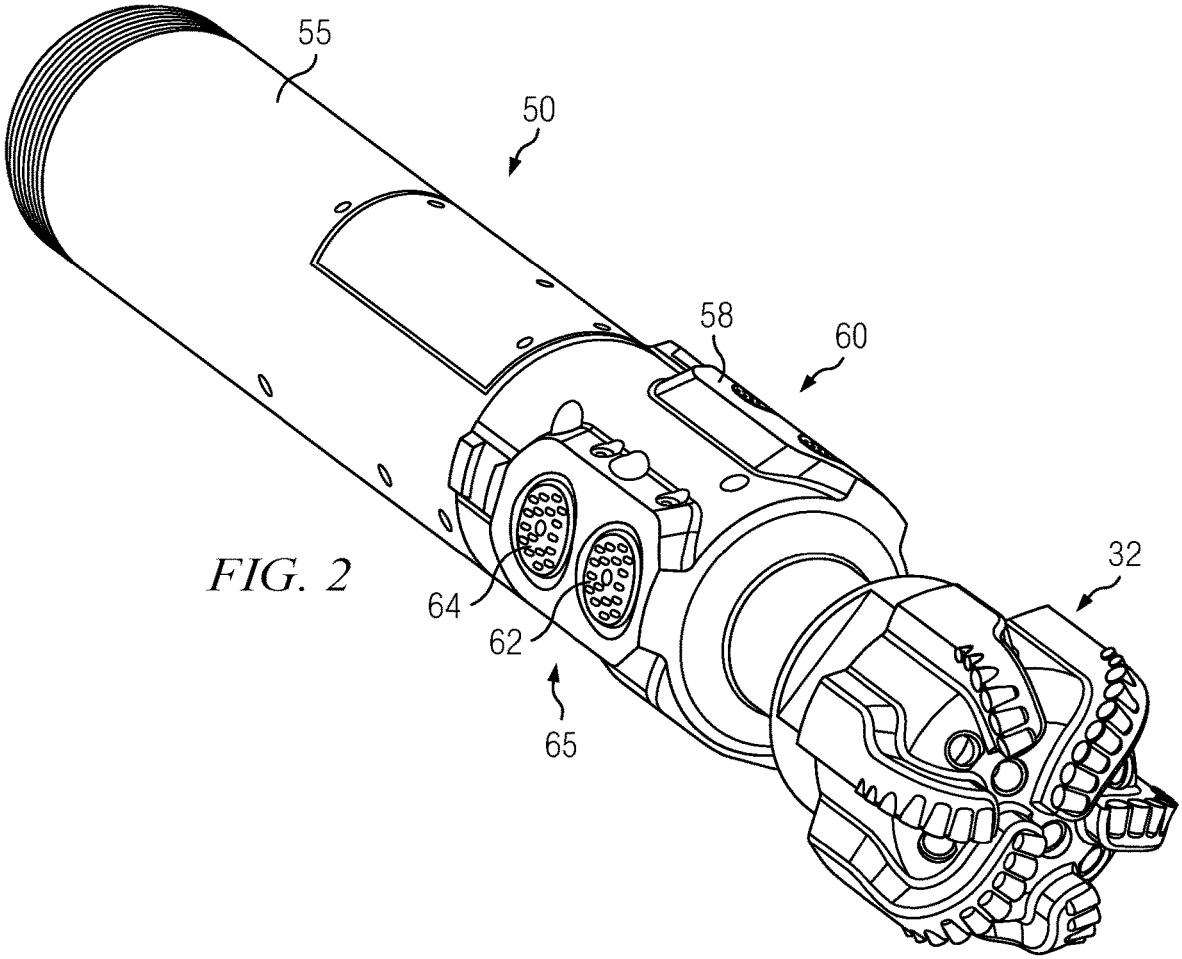
FIG. 2 depicts an example lower BHA portion of the drill string shown on FIG. 1 on which disclosed embodiments may be utilized.

FIG. 2 depicts the lower BHA portion of drill string 30 including drill bit 32 and one example rotary steerable tool 50. As noted above, the rotary steerable tool 50 may include substantially any suitable commercially available or experimental steering tool. The disclosed embodiments are not limited in this regard. In the embodiment depicted on FIG. 2, the tool 50 includes three circumferentially spaced pad pairs 65 (e.g., spaced at 120 degree intervals about the tool circumference). Each pad pair 65 includes first and second axially spaced pads 62 and 64 deployed in/on a gauge surface 58 of a collar 55 configured to rotate with the drill string. Each of the pads 60 is configured to extend outward from the collar 55 into contact with the wellbore wall and thereby actuate steering.

Figure 3:
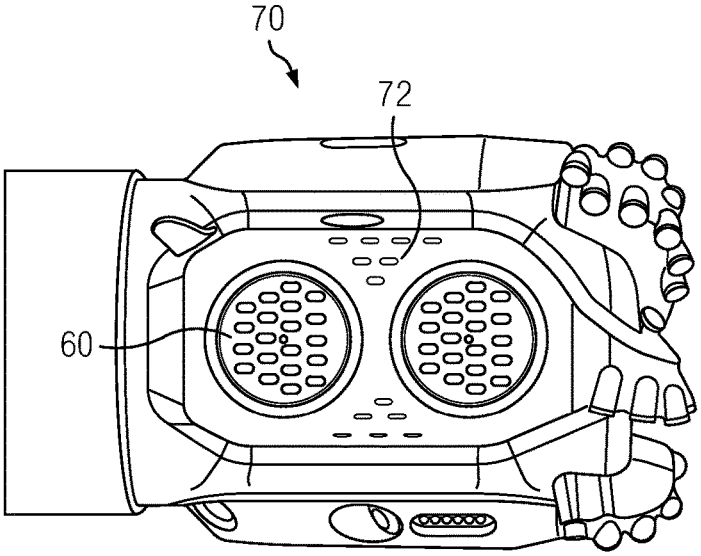
FIG. 3 depicts an example steerable drill bit on which disclosed embodiments may be utilized.

Turning now to FIG. 3, it will be understood that the disclosed embodiments are not limited to rotary drilling embodiments in which the drill bit 32 and rotary steerable tool 50 are distinct separable tools (or tool components). FIG. 3 depicts a steerable drill bit 70 including a plurality of steering pads 60 deployed in the sidewall of the bit body 72 (e.g., on wellbore gauge surfaces). Steerable bit 70 may be thought of as an integral drilling system in which the rotary steerable tool and the drill bit are integrated into a single tool (drill bit) body 72. Drill bit 70 may include substantially any suitable number of pads 60, for example, three pairs of circumferentially spaced pad pairs in which each pad pair includes first and second axially spaced pads as described above with respect to FIG. 2. The disclosed embodiments are not limited in this regard.

Figure 4:
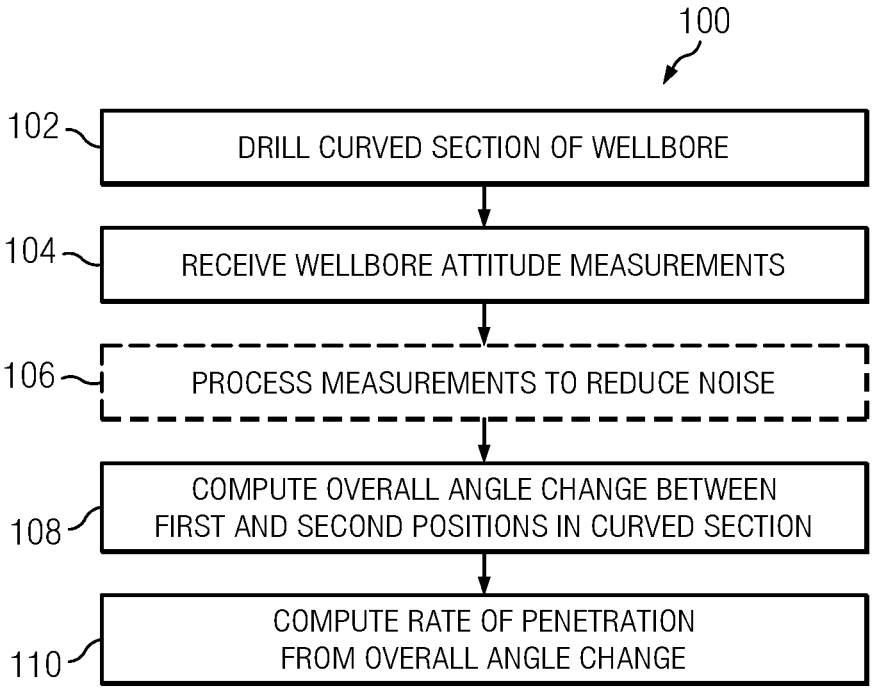
FIG. 4 depicts a flow chart of one example method embodiment for estimating the rate of penetration while drilling.

FIG. 4 depicts a flow chart of one example method embodiment 100 for estimating a rate of penetration while drilling a subterranean wellbore. The method includes rotating a bottom hole assembly (BHA) in the subterranean wellbore at 102 to drill the well. The BHA includes at least a drill bit and a steering tool such as one of the rotary steerable tools and/or bits described above with respect to FIGS. 1-3. It will be understood that the BHA may be rotated at 102 from the surface (e.g., using a top drive), from a downhole position in the drill string above the steering tool 50 (e.g., using a mud motor), or from both the surface and the downhole position (e.g., as in a power drilling operation). The disclosed embodiments are not limited in this regard.

In method 100 the steering tool is actuated to drill a curved section of wellbore (i.e., a section of wellbore in which the wellbore attitude changes with measured depth). Wellbore attitude (wellbore inclination and wellbore azimuth) measurements are received at 104. Such wellbore surveying measurements may be received, for example, from a measurement while drilling tool deployed elsewhere in the drill string or from the steering tool. The wellbore surveying measurements are made in the steering tool, having a close proximity to the drill bit (e.g., using a triaxial magnetometer set and a triaxial accelerometer set deployed in the steering tool (e.g., a roll stabilized control unit of a rotary steerable tool). The wellbore inclination and wellbore azimuth measurements may also advantageously be made continuously while drilling, for example, as disclosed in commonly assigned U.S. Pat. No. 9,273,547 which is incorporated by reference in its entirety herein.

With continued reference to FIG. 4, method 100 may further optionally include pre-processing (conditioning) 106 the wellbore inclination and wellbore azimuth measurements made in 104. For example, the measurements may be filtered (e.g., via low pass filtering) to remove high frequency noise or spikes and may further be averaged over a predetermined measurement interval. The filtered wellbore inclination and wellbore azimuth measurements may then be further processed at 108 to compute an overall angle change of the wellbore between first and second measurement positions (between first and second measurement times t1 and t2). The overall angle change ΔØ may be computed, for example, using the following equation (based on the wellbore inclination and wellbore azimuth measurements a the first and second positions/times):

$$\Delta\emptyset=\cos^{-1}[\sin(Inc1)\sin(Inc2)\cos(Az2-Az1)+\cos(inc1)\cos(Inc2)] \quad (1)$$

where Inc1 and Inc2 represent the wellbore inclination at first and second times and Az1 and Az2 represent the wellbore azimuth at the first and second times. These wellbore inclination and wellbore azimuth values may be obtained at substantially any suitable first and second times defining a time interval Δt=t2−t1. The rate of penetration while drilling ROP may then be computed from the overall angle change at 110, for example, as follows:

$$ROP = \frac{\Delta\emptyset}{\Delta t \cdot DLS} \quad (2)$$

where ΔØ is defined above, Δt represents the time interval, and DLS represents the dogleg severity (the curvature) of the curved section of the wellbore in units of angle change per change in measured depth (e.g., DLS is often expressed in unites of degrees per 100 feet of wellbore length). Note that the rate of penetration ROP is proportional to the overall angle change ΔØ and inversely proportional to the time interval Δt (and therefore proportional to the ratio of the overall angle change to the time interval).

In certain rotary steerable tool embodiments, the dogleg severity may be defined as the product of the maximum dogleg severity of the tool and the steering ratio such that: $DLS=DLS_{max}\cdot SR$. Those of ordinary skill in the art will readily appreciate that certain rotary steerable tools alternate between bias and neutral phases (essentially steering and non-steering phases) and that the steering ratio SR represents the fraction of time spent actively steering. For such systems, ROP may be computed from the overall angle change at 110, for example, as follows:

$$ROP = \frac{\Delta\emptyset}{\Delta t \cdot DLS_{max} \cdot SR} \tag{3}$$

where $DLS_{max}$ represents the maximum achievable dogleg severity of the steering tool in units of angle change per change in measured depth (e.g., degrees per 100 feet) and SR represents the steering ratio having a value between 0 and 1.

Figure 5A:
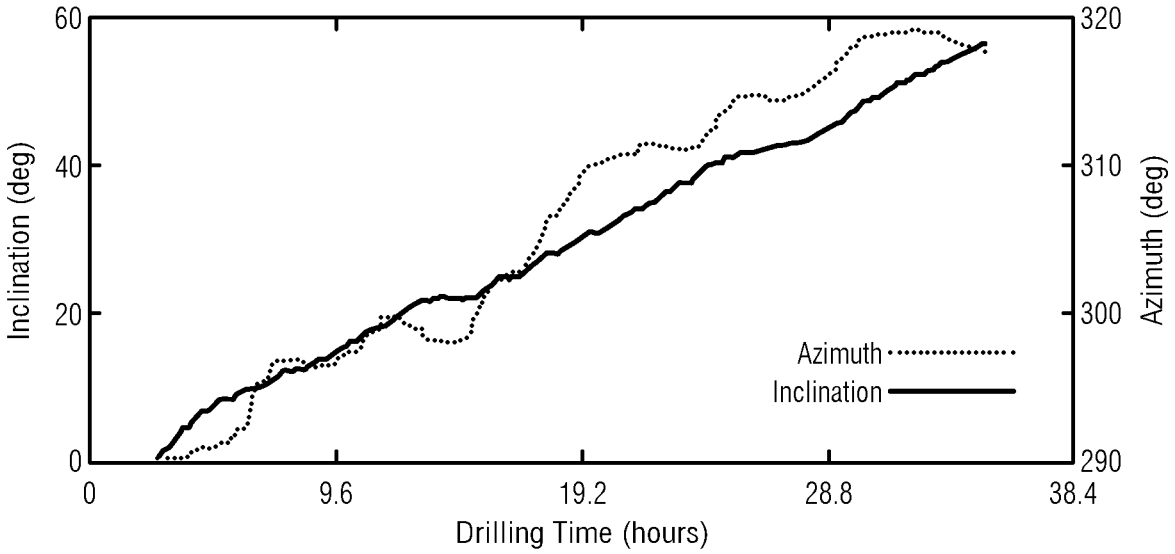
FIGS. 5A and 5B (collectively FIG. 5) depict plots of inclination and azimuth versus drilling time (5A) and the corresponding rate of penetration versus drilling time (5B) for a drilling operation.
Figure 5B:
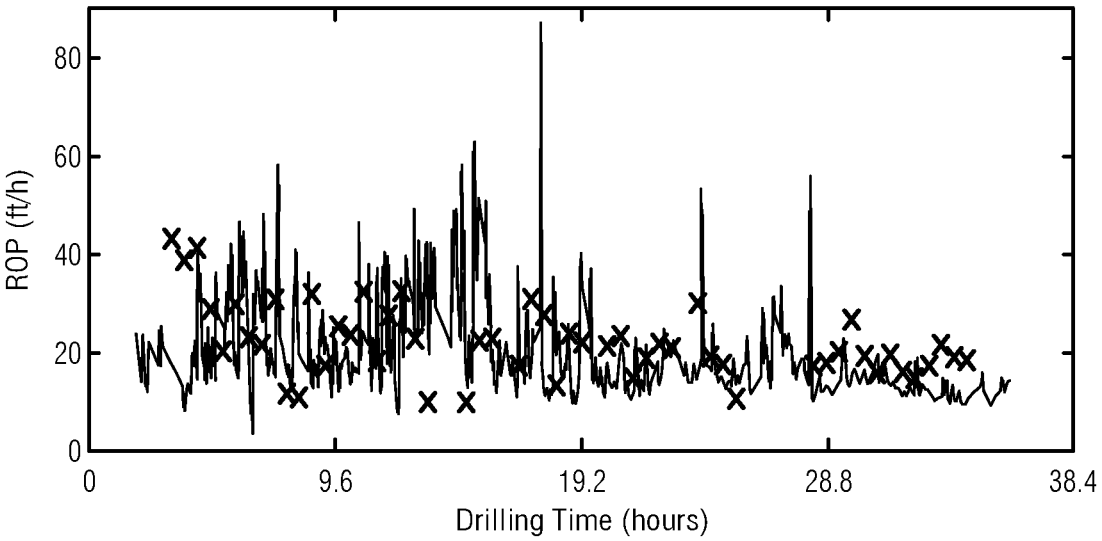

FIGS. 5A and 5B (collectively FIG. 5) depict plots of inclination and azimuth versus drilling time (5A) and the corresponding rate of penetration versus drilling time (5B) for a drilling operation. In this example, a rotary steerable system was used to drill a complex wellbore that was building wellbore inclination from about 0 to about 50 degrees inclination and turning from a wellbore azimuth of about 290 to about 320 degrees. In FIG. 5A the wellbore inclination is plotted using a solid line and is referenced with respect to the left-hand vertical axis and the wellbore azimuth is plotted using a dashed line and is referenced with respect to the right-hand vertical axis. In FIG. 5B, the field ROP (as measured using conventional surface techniques) is plotted using a solid line. The individual downhole measurements made using method 100 are plotted using the symbol 'x'. As is readily apparent from the ROP measurements set forth in FIG. 5B, the downhole ROP measurements are in good agreement with the field ROP measurements.

Figure 6A:
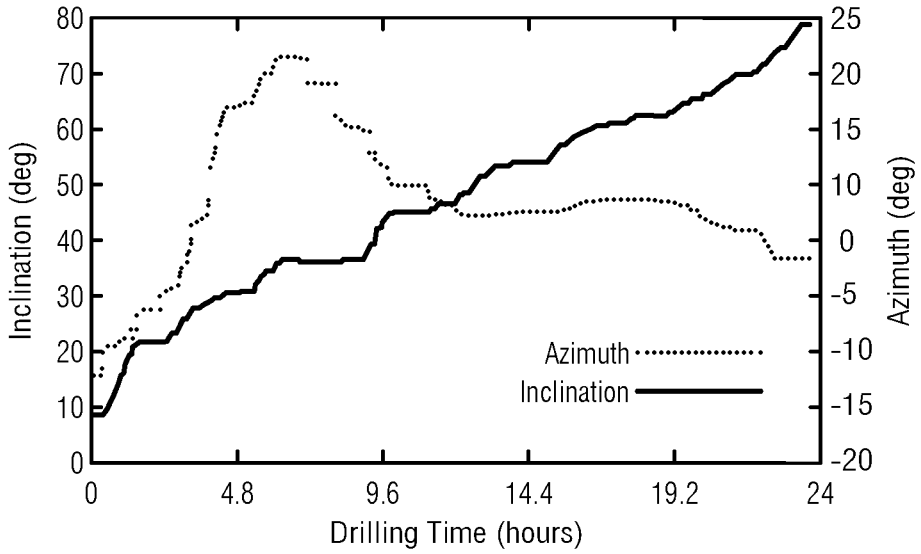
FIGS. 6A and 6B (collectively FIG. 6) depict plots of inclination and azimuth versus drilling time (6A) and the corresponding rate of penetration versus drilling time (6B) for another drilling operation.
Figure 6B:
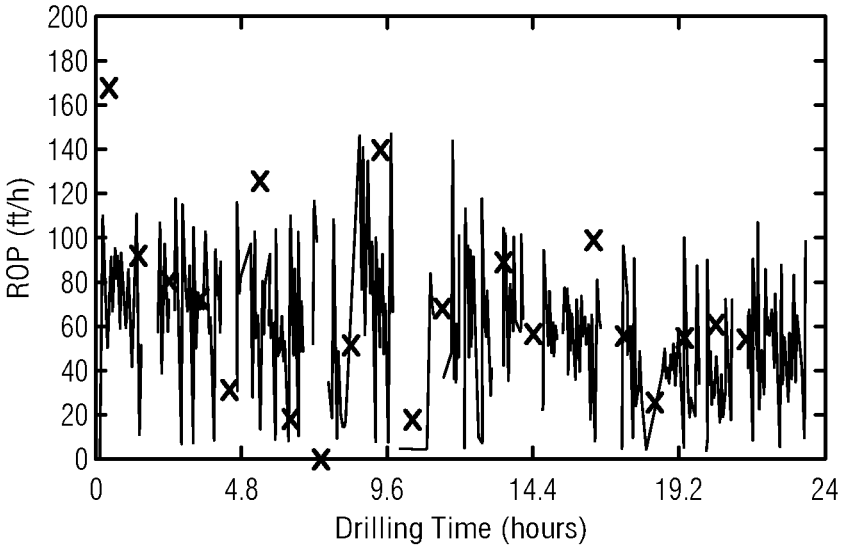

FIGS. 6A and 6B (collectively FIG. 6) depict plots of inclination and azimuth versus drilling time (6A) and the corresponding rate of penetration versus drilling time (6B) for a drilling operation. In this example, a rotary steerable system was used to drill a complex wellbore that was building wellbore inclination from about 10 to about 80 degrees inclination and turning from a wellbore azimuth of about −10 to about 20 degrees and then back to about 0 degrees. In FIG. 6A the wellbore inclination is plotted using a solid line and is referenced with respect to the left-hand vertical axis and the wellbore azimuth is plotted using a dashed line and is referenced with respect to the right-hand vertical axis. In FIG. 6B, the field ROP (as measured using conventional surface techniques) is plotted using a solid line. The individual downhole measurements made using method 100 are plotted using the symbol 'x'. As is readily apparent from the ROP measurements set forth in FIG. 6B, the downhole ROP measurements are in good agreement with the field ROP measurements.

Figure 7:
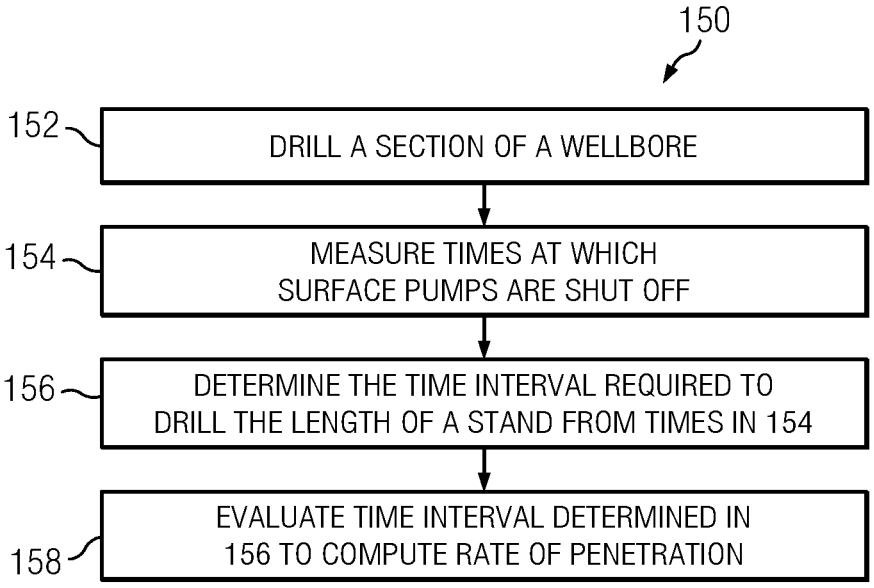
FIG. 7 depicts a flow chart of another example method embodiment for estimating the rate of penetration while drilling.

FIG. 7 depicts a flow chart of another example method embodiment 150 for estimating the rate of penetration while drilling. The method includes rotating a bottom hole assembly (BHA) in the subterranean wellbore at 152 to drill. The BHA includes at least a drill bit and a steering tool such as one of the rotary steerable tools and/or steerable bits described above with respect to FIGS. 1-3. Method 150 estimates the average rate of penetration over the length of a stand of drilling pipe. It will be understood that a stand of drilling pipe may include substantially any number of wellbore tubulars (referred to as "joints" in the art) that are connected to the drill string as a unit. Depending on the configuration of the drilling rig, one stand may include a single wellbore tubular (e.g., having a length of about 30 feet) or any plurality of wellbore tubulars (e.g., stands having two or three tubulars and a combined length in a range from about 40 to about 120 feet are most common). Those of ordinary skill in the art will readily appreciate that the wellbore tubulars in each stand are threaded together prior to connection with the drill string and are generally stood upright in the derrick in preparation for use.

At 154 downhole pressure measurements and/or turbine voltage measurements are evaluated to determine time instances at which the surface pumps are shut down (turned off). The downhole pressure measurements or turbine voltage measurements may be processed at 156 to determine a time interval required to drill the length of the stand. For example, the "pumps off" events may be taken to represent the connection time at which a new stand is added to the drill string and the time interval between sequential pumps off events may be taken to represent the time interval required to drill the length of the stand. It will be understood the surface pumps may be shut down for reasons other than connecting a new stand to the drill string. As described in more detail below, the processing at 156 may therefore further include filters or logic intended to eliminate such time instances.

The time interval required to drill the length of the stand may be evaluated at 158 to compute the average rate of penetration over the length of the stand. For example, the rate of penetration may be computed as follows:

$$ROP = \frac{L}{\Delta t} \tag{4}$$

where L represents the length of the stand and Δt represents the time interval required to drill the length of the stand. The time interval Δt may be determined, for example, by subtracting the time at which the pumps are turned off from the previous time at which the pumps were turned on (e.g., as determined by downhole pressure and/or turbine voltage measurements). In practice it is sometimes only possible to record time stamps at which the pumps are on (or turned on). In such embodiments, the measured time interval $\Delta t_m$ may represent the time interval between sequential "pumps on" events and may therefore include the connection time required to connect the pipe stand. In such embodiments, the rate of penetration may be advantageously computed, for example, as follows:

$$ROP = \frac{L}{\Delta t_m - t_{connect}} \tag{5}$$

where $t_{connect}$ represents an approximate or average connection time. It will be understood that no drilling takes place during the connection time and that subtracting this time (or an estimate of the connection time) from the time interval may improve the accuracy of the computed ROP.

With continued reference to FIG. 7, the processing at 156 may further include evaluating the time instances recorded in 154 to select suitable time intervals that most likely correspond with the aforementioned connection events at which a new stand of drill pipe is connected to the drill string and to eliminate those instances at which the pumps were shut down for other reasons. For example, based on a-priori knowledge of the drilling operation, the ROP may be restricted to an acceptable range of values (e.g., within a range of about 5 to about 300 feet per hour or to a more narrow range if specific details are known regarding the subterranean formation). Acceptable time intervals may then be computed based on the known length of the stand. For example, when the stand is 90 feet, the minimum acceptable time interval $\Delta t_{min}$ may be 0.3 hours ($\Delta t_{min}$=90/300) and the maximum acceptable time interval $\Delta t_{max}$ may be 18 hours ($\Delta t_{max}$=90/5). In such an example, measured time intervals outside the range from 0.3 to 18 hours may be eliminated and not used to compute the rate of penetration. In embodiments in which both "pumps on" and "pumps off" events are detected at 154, a minimum connection time may also be used (with connection times less than the minimum being understood to be unrealistically fast). For example, time instance may be eliminated if the time difference between a pumps off event and the subsequent pumps on event are less than a minimum threshold (e.g., 5 minutes).

Figure 8A:
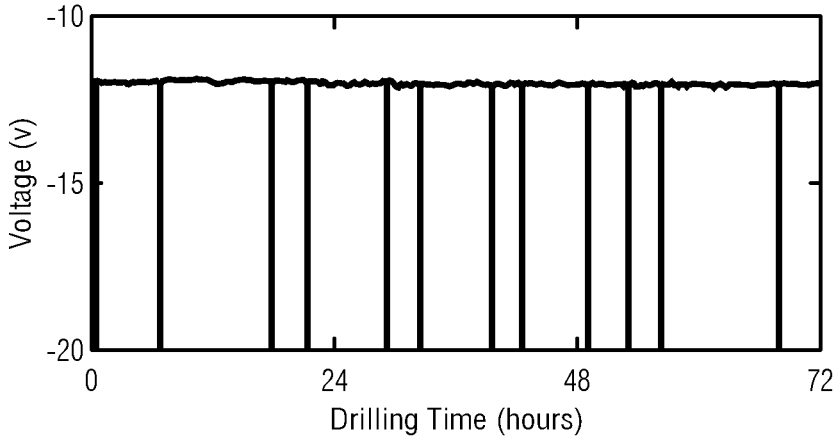
FIGS. 8A and 8B (collectively FIG. 8) depict plots of voltage versus drilling time (8A) and the corresponding rate of penetration versus drilling time (8B) for a drilling operation.
Figure 8B:
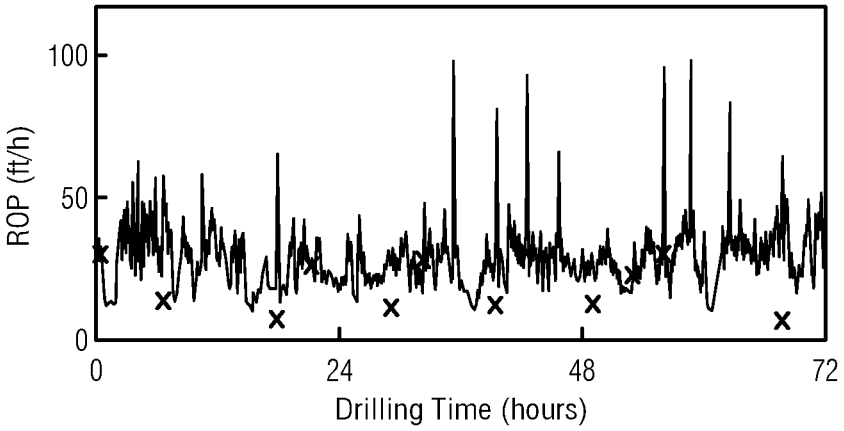

FIGS. 8A and 8B (collectively FIG. 8) depict plots of turbine voltage versus drilling time (8A) and the corresponding rate of penetration versus drilling time (8B) for a drilling operation. In this example, a rotary steerable system was used to drill a section of a wellbore. In FIG. 8A the times at which the pumps were shut down (turned off) are indicated by a sharp change in voltage (from about −12V to about −20V in this example). In FIG. 8B, the field ROP (as measured using conventional surface techniques) is plotted using a solid line. The individual downhole measurements made using method 150 are plotted using the symbol 'x'. As is readily apparent from the ROP measurements set forth in FIG. 8B, the downhole ROP measurements are in good agreement with the field ROP measurements.

Figure 9:
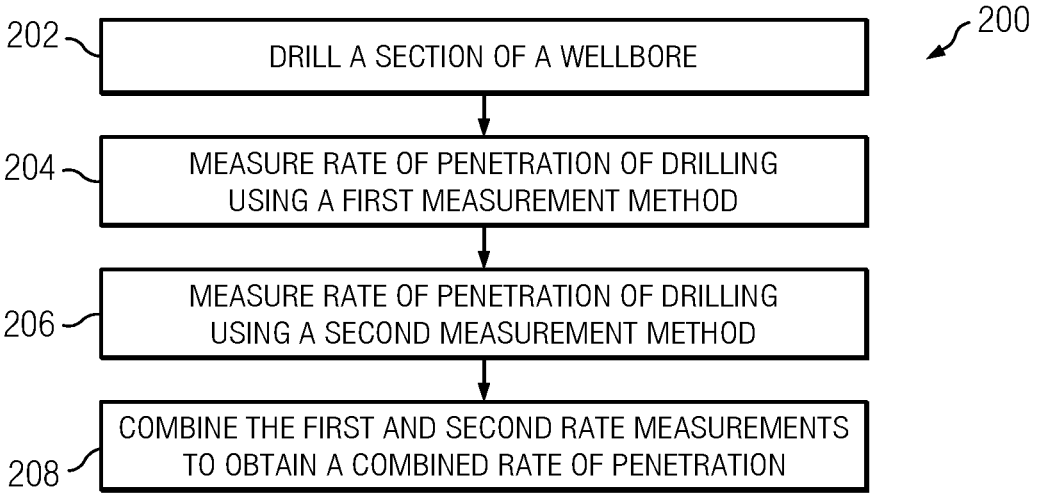
FIG. 9 depicts a flow of still another example method embodiment for estimating the rate of penetration while drilling.

FIG. 9 depicts a flow chart of yet another disclosed method 200 for estimating the rate of penetration while drilling. Method 200 includes rotating a bottom hole assembly (BHA) in the subterranean wellbore at 202 to drill. The BHA includes at least a drill bit and a steering tool such as one of the rotary steerable tools and/or steerable bits described above with respect to FIGS. 1-3. Method 200 provides a fused (or combined) rate of penetration based on at least first and second ROP measurements made using corresponding first and second different measurement methods. For example, method 200 may provide a fused ROP measurement based on the ROP measurement techniques described above with respect to FIGS. 4 and 7 (methods 100 and 150). A first ROP measurement is made using a first ROP measurement method at 204 and a second ROP measurement is made using a second ROP measurement method at 206 (in which the first and second ROP measurement methods are not the same). In one example embodiment, the first ROP measurement method may include method 100 described above with respect to FIG. 4 and the second ROP measurement method may include method 150 described above with respect to FIG. 7.

With continued reference to FIG. 9, the first and second ROP measurements (made at 204 and 206) are combined at 208 to obtain a combined ROP measurement. For example, the first and second ROP measurements may be averaged at 208 to obtain an average ROP value or a weighted average ROP value. Such averaging may be represented mathematically, for example, as follows:

$$ROP_{com}=K\cdot ROP_1+(1-K)ROP_2 \tag{6}$$

where $ROP_{com}$ represents the combined rate of penetration, $ROP_1$ and $ROP_2$ represent the first and second ROP measurements obtained in 204 and 206, and K represents a coefficient having a value from 0 to 1. The value of K may be selected, for example, based on the section of wellbore being drilled. For example, in embodiments in which methods 100 and 150 are used to obtain the first and second ROP measurements, K may be set to zero for vertical and horizontal sections of the wellbore. For curved sections of the wellbore the value of K may be close to or equal to unity (e.g., in a range from about 0.5 to about 1).

In another example embodiment, the second ROP measurement may be used to calibrate the first ROP measurement and to thereby obtain a calibrated ROP measurement (or to facilitate making subsequent calibrated ROP measurements). In one example embodiment, method 150 may be used to calibrate method 100. For example, an overall angle change $\Delta\emptyset$ may be measured at 204 as described above in 104, 106, and 108 of FIG. 4 while drilling a curved section of wellbore. At 206 a second ROP measurement may be made using method 150 to obtain an average ROP measured over the length of a pipe stand as described above in 154 and 156 of FIG. 7. The second ROP measured in 206 may then be used to calibrate the first ROP measurement made in 204, for example, by substituting the second ROP value measured in 206 into equation 3 and solving for $DLS_{max}$. This may be expressed mathematically, for example, as follows:

$$DLS_{max-c}=\frac{\Delta\phi}{\Delta t\cdot ROP_2\cdot SR} \tag{7}$$

where $ROP_2$ represents the second ROP measurement made in 204 and $DLS_{max-c}$ represents a calibrated maximum dogleg severity. Such calibration may be advantageous in certain drilling operations since $DLS_{max}$ is not generally a fixed value, but may depend on various operational parameters including the type of drill bit used, BHA characteristics, and formation properties.

Subsequent calibrated ROP measurements $ROP_{cal}$ may then be computed based on subsequent overall angle change measurements (using method 100 as described above with respect to FIG. 4), for example, as follows:

$$ROP_{cal}=\frac{\Delta\phi}{\Delta t\cdot DLS_{max-c}\cdot SR} \tag{8}$$

While method 200 is described above with respect to the use of methods 100 and 150 as first and second ROP measurement methods, it will be understood that the disclosed embodiments are not so limited. Substantially any suitable first and second ROP measurement methods may be utilized. For example, in certain embodiments, the first ROP measurement method may include method 100, while the second ROP measurement method may include substantially any suitable other downhole ROP measurement method. In addition to method 150 described above with respect FIG. 7, other ROP measurement methods may include, for example, methods in which first and second data logs acquired using corresponding first and second axially spaced sensors are correlated to compute a time shift. The time shift may in turn be processed in combination with the axial spacing between the sensors to compute the rate of penetration. Such methods are disclosed in commonly assigned U.S. Pat. Nos. 9,027,670 and 9,970,285, both of which are incorporated by reference in their entirety. In another method radial displacements of first and second axially spaced pads (e.g., as depicted in FIGS. 2 and 3) in the rotary steerable tool or bit may be measured (and optionally correlated) to compute the rate of penetration as disclosed in U.S. Provisional Patent Application Ser. No. 62/952,107 filed Dec. 20, 2019, which is incorporated by reference in its entirety and attached hereto.

With further reference to FIGS. 4, 7, and 9, it will be understood that the ROP values computed in methods 100, 150, and 200 may be stored in downhole memory and/or transmitted to the surface, for example, via mud pulse telemetry, electromagnetic telemetry (or other telemetry techniques). With still further reference to FIGS. 4, 7, and 9, the computed ROP values may be further used in controlling the drilling process. For example, the computed ROP values may be utilized in automated drilling methods used to control the direction of drilling based on various downhole feedback measurements, such as wellbore inclination and azimuth measurements made while drilling or logging while drilling measurements. For example, such methods may be intended to control the wellbore curvature such as the build rate or turn rate of the wellbore, or to control a complex curve while drilling. Example automated drilling methods are disclosed in commonly assigned U.S. Pat. Nos. 9,404,355; 9,945,222; 10,001,004; and 10,214,964, which are incorporated by reference in their entirety.

It will be appreciated that the disclosed methods may be configured for implementation via one or more controllers deployed downhole (e.g., in a rotary steerable tool such as one of the rotary steerable tools 50 described above with respect to FIGS. 1-2). A suitable controller may include, for example, a programmable processor, such as a digital signal processor or other microprocessor or microcontroller and processor-readable or computer-readable program code embodying logic. A suitable processor may be utilized, for example, to execute the method embodiments (or various steps in the method embodiments) described above with respect to FIGS. 4, 7, and 9 as well as to compute corresponding ROP values using one or more of Equations 1-8. A suitable controller may also optionally include other controllable components, such as sensors (e.g., a temperature sensor), data storage devices, power supplies, timers, and the like. The controller may also be disposed to be in electronic communication with the accelerometers and magnetometers. A suitable controller may also optionally communicate with other instruments in the drill string, such as, for example, telemetry systems that communicate with the surface. A suitable controller may further optionally include volatile or non-volatile memory or a data storage device.

It will be understood that this disclosure may include numerous embodiments. These embodiments include, but are not limited to, the following embodiments.

A first embodiment may include a method for estimating a rate of penetration while drilling a subterranean wellbore. The method may include (a) rotating a bottom hole assembly in the subterranean wellbore to drill, the drill string including a rotary steerable tool or a steerable drill bit; (b) measuring a first rate of penetration of drilling in (a) using a first measurement method; (c) measuring a second rate of penetration of drilling in (a) using a second measurement method; and (d) combining the first rate of penetration and the second rate of penetration to obtain a combined rate of penetration of drilling in (a).

A second embodiment may include the first embodiment where (d) includes computing an average or weighted average of the first rate of penetration and the second rate of penetration to obtain the combined rate of penetration.

A third embodiment may include the first embodiment where (d) includes processing the second rate of penetration in combination with the first rate of penetration to obtain a calibrated first rate of penetration.

A fourth embodiment may include any one of the first three embodiments where: (a) includes rotating a bottom hole assembly in the subterranean wellbore to drill a curved section of the wellbore; and (b) includes (i) measuring wellbore inclination and wellbore azimuth while drilling in (a), (ii) processing the wellbore inclination measurements and the wellbore azimuth measurements to compute an overall angle change between first and second axially spaced positions in the curved section, and (iii) processing the overall angle change to compute the first rate of penetration.

A fifth embodiment may include the fourth embodiment where the first rate of penetration is proportional to a ratio of the overall angle change and the time interval required to drill between the first and second positions in the curved section.

A sixth embodiment may include the fourth or fifth embodiment where the first rate of penetration is computed using the following mathematical equation:

$$ROP = \frac{\Delta\phi}{\Delta t \cdot DLS_{max} \cdot SR} \tag{9}$$

where ROP represents the first rate of penetration, ΔØ represents the overall angle change, Δt represents a time interval required to drill the curved section between the first and second positions in the curved section, $DLS_{max}$ represents a maximum dogleg severity of the rotary steerable tool or steerable bit, and SR represents a steering ratio.

A seventh embodiment may include the sixth embodiment where (d) includes processing the second rate of penetration to compute a calibrated maximum dogleg severity.

An eighth embodiment may include the seventh embodiment where the calibrated maximum dogleg severity is computed using the following mathematical equation:

$$DLS_{max-c} = \frac{\Delta\phi}{\Delta t \cdot ROP_2 \cdot SR} \tag{10}$$

where $DLS_{max-c}$ represents the calibrated maximum dogleg severity and $ROP_2$ represents the second rate of penetration.

A ninth embodiment may include the eighth or ninth embodiment, where the method further includes: (e) obtaining calibrated rate of penetration measurements based on subsequent overall angle change measurements and the calibrated maximum dogleg severity.

A tenth embodiment may include any one of the first nine embodiments where (c) further includes (i) measuring times at which surface pumps are shut off while drilling in (a), (ii) processing the times at which the pumps are shut off to determine a time interval required to drill a length of a stand of drilling pipe, and (iii) processing the time interval and the length of the stand of drilling pipe to compute the second rate of penetration.

An eleventh embodiment may include the tenth embodiment where the second rate of penetration is computed by dividing the length of the stand by the time interval required to drill the length of the stand.

A twelfth embodiment includes a method for estimating a rate of penetration while drilling a subterranean wellbore. The method may include: (a) rotating a bottom hole assembly in the subterranean wellbore to drill, the drill string including a rotary steerable tool or a steerable drill bit; (b) measuring times at which surface pumps are shut off while drilling in (a); (c) processing the times at which the pumps are shut off to determine a time interval required to drill a length of a stand of drilling pipe, and (d) processing the time interval and the length of the stand of drilling pipe to compute the rate of penetration of drilling in (a).

A thirteenth embodiment may include the twelfth embodiment where (b) further includes making downhole pressure measurements or turbine voltage measurements to determine the times at which the surface pumps are shut off.

A fourteenth embodiment may include the twelfth or thirteen embodiment where (c) further includes evaluating the times at which the surface pumps are shut off to select the times at which a new stand of drill pipe is connected and processing the times at which a new stand of drill pipe is connect to compute the time interval.

A fifteenth embodiment may include any one of the twelfth through fourteenth embodiments where the rate of penetration is computed by dividing the length of the stand by the time interval required to drill the length of the stand.

A sixteenth embodiment may include the fifteenth embodiment where the rate of penetration is computed according to the following mathematical equation:

$$ROP = \frac{L}{\Delta t_m - t_{connect}} \tag{11}$$

where ROP represents the rate of penetration, L represents the length of the stand, $\Delta t_m$ represents a time interval between sequential pumps on events, and $t_{connect}$ represents an approximate or average time required to connect the stand of drill pipe.

A seventeenth embodiment includes a method for estimating a rate of penetration while drilling a subterranean wellbore. The method may include: (a) rotating a bottom hole assembly in the subterranean wellbore to drill a curved section of a wellbore; (b) measuring wellbore inclination and wellbore azimuth while drilling in (a); (c) processing the wellbore inclination measurements and the wellbore azimuth measurements to compute an overall angle change between first and second axially spaced positions in the curved section; and (d) processing the overall angle change to compute a rate of penetration of drilling in (a).

An eighteenth embodiment may include the seventeenth embodiment where the rate of penetration is proportional to a ratio of the overall angle change and a time interval required to drill between the first and second positions in the curved section.

A nineteenth embodiment may include the seventeenth or eighteenth embodiment where the rate of penetration is computed in (d) using the following mathematical equation:

$$ROP = \frac{\Delta\phi}{\Delta t \cdot DLS} \tag{12}$$

where ROP represents the rate of penetration, ΔØ represents the overall angle change, Δt represents the time interval, and DLS represents a dogleg severity of the curved section drilled in (a).

A twentieth embodiment may include the seventeenth or eighteenth embodiment where the rate of penetration is computed in (d) using the following mathematical equation:

$$ROP = \frac{\Delta\phi}{\Delta t \cdot DLS_{max} \cdot SR} \tag{13}$$

where ROP represents the rate of penetration, ΔØ represents the overall angle change, Δt represents the time interval, $DLS_{max}$ represents a maximum dogleg severity of the rotary steerable tool or steerable bit, and SR represents a steering ratio.

Although a method for estimating the rate of penetration while drilling has been described in detail, it should be understood that various changes, substitutions and alterations may be made herein without departing from the spirit and scope of the disclosure. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

What is claimed is:

1. A method for estimating a rate of penetration while drilling a subterranean wellbore, the method comprising:

(a) rotating a bottom hole assembly in the subterranean wellbore to drill a curved section of the wellbore utilizing a drill string including a rotary steerable tool or a steerable drill bit;

(b) measuring a first rate of penetration of the drilling in (a) using a first measurement method, wherein measuring the first rate of penetration comprises (i) measuring wellbore inclination and wellbore azimuth while drilling in (a), (ii) processing the wellbore inclination measurements and the wellbore azimuth measurements to compute an overall angle change between first and second axially spaced positions in the curved section, and (iii) processing the overall angle change to compute the first rate of penetration;

(c) measuring a second rate of penetration of the drilling in (a) using a second measurement method; and (d) combining the first rate of penetration and the second rate of penetration to obtain a combined rate of penetration of the drilling in (a).

2. The method of claim 1, wherein (d) comprises computing an average or weighted average of the first rate of penetration and the second rate of penetration to obtain the combined rate of penetration.

3. The method of claim 1, wherein (d) comprises processing the second rate of penetration in combination with the first rate of penetration to obtain a calibrated first rate of penetration.

4. The method of claim 1, wherein the first rate of penetration is proportional to a ratio of the overall angle change and the time interval required to drill between the first and second positions in the curved section.

5. The method of claim 1, wherein the first rate of penetration is computed using the following mathematical equation:

$$ROP = \frac{\Delta\phi}{\Delta t \cdot DLS_{max} \cdot SR}$$

wherein ROP represents the first rate of penetration, ΔØ represents the overall angle change, Δt represents a time interval required to drill the curved section between the first and second positions in the curved section, $DLS_{max}$ represents a maximum dogleg severity of the rotary steerable tool or steerable bit, and SR represents a steering ratio.

6. The method of claim 5, wherein (d) comprises processing the second rate of penetration to compute a calibrated maximum dogleg severity.

7. The method of claim 6, wherein the calibrated maximum dogleg severity is computed using the following mathematical equation:

$$DLS_{max-c} = \frac{\Delta\phi}{\Delta t \cdot ROP_2 \cdot SR}$$

wherein $DLS_{max-c}$ represents the calibrated maximum dogleg severity and $ROP_2$ represents the second rate of penetration.

8. The method of claim 6, further comprising:

(e) obtaining calibrated rate of penetration measurements based on subsequent overall angle change measurements and the calibrated maximum dogleg severity.

9. The method of claim 1, wherein (c) further comprises (i) measuring times at which surface pumps are shut off while drilling in (a), (ii) processing the times at which the pumps are shut off to determine a time interval required to drill a length of a stand of drilling pipe, and (iii) processing the time interval and the length of the stand of drilling pipe to compute the second rate of penetration.

10. The method of claim 9, wherein the second rate of penetration is computed by dividing the length of the stand by the time interval required to drill the length of the stand.

11. A method for estimating a rate of penetration while drilling a subterranean wellbore, the method comprising:

(a) rotating a bottom hole assembly in the subterranean wellbore to drill utilizing a drill string including a rotary steerable tool or a steerable drill bit;

(b) measuring times at which surface pumps are shut off while drilling in (a);

(c) processing the times at which the pumps are shut off to determine a time interval required to drill a length of a stand of drilling pipe, and (d) processing the time interval and the length of the stand of drilling pipe to compute the rate of penetration of drilling in (a), wherein the rate of penetration is computed according to the following mathematical equation:

$$ROP = \frac{L}{\Delta t_m - t_{connect}}$$

wherein ROP represents the rate of penetration, L represents the length of the stand, $\Delta t_m$ represents a time interval between sequential pumps on events, and $t_{connect}$ represents an approximate or average time required to connect the stand of drill pipe.

12. The method of claim 11, wherein (b) further comprises making downhole pressure measurements or turbine voltage measurements to determine the times at which the surface pumps are shut off.

13. The method of claim 11, wherein (c) further comprises evaluating the times at which the surface pumps are shut off to select the times at which a new stand of drill pipe is connected and processing the times at which a new stand of drill pipe is connected to compute the time interval.

14. A method for estimating a rate of penetration while drilling a subterranean wellbore, the method comprising:

(a) rotating a bottom hole assembly in the subterranean wellbore to drill a curved section of a wellbore;

(b) measuring wellbore inclination and wellbore azimuth while drilling in (a);

(c) processing the wellbore inclination measurements and the wellbore azimuth measurements to compute an overall angle change between first and second axially spaced positions in the curved section; and (d) processing the overall angle change to compute a rate of penetration of drilling in (a), wherein the rate of penetration is computed in (d) using the following mathematical equation:

$$ROP = \frac{\Delta\phi}{\Delta t \cdot DLS}$$

wherein ROP represents the rate of penetration, ΔØ represents the overall angle change, Δt represents a time interval required to drill between the first and second positions in the curved section, and DLS represents a dogleg severity of the curved section drilled in (a).

* * * * *